United States Patent [19]

David et al.

[11] Patent Number: 5,065,815

[45] Date of Patent: Nov. 19, 1991

[54] FORCE FREE SUSPENSION OF HEAT EXCHANGE BUNDLES WITH HIGH TEMPERATURE ADMISSION FLOW

[75] Inventors: Helmut David; J. Ernst Malik; Rainer Schmidt, all of Oberhausen, Fed. Rep. of Germany

[73] Assignee: Man Gutehoffnungshütte Aktinegesellschaft, Oberhausen, Fed. Rep. of Germany

[21] Appl. No.: 602,794

[22] Filed: Oct. 24, 1990

[30] Foreign Application Priority Data

Oct. 27, 1989 [DE] Fed. Rep. of Germany ..... 3935871

[51] Int. Cl.[5] ..... F28F 9/00

[52] U.S. Cl. ..... 165/67; 165/81; 165/145; 165/176

[58] Field of Search ..... 165/67, 81, 82, 145, 165/139, 176; 122/510, 511

[56] References Cited

U.S. PATENT DOCUMENTS 2,302,513 11/1942 Abraham, Jr. ..... 165/139 X
2,401,918 6/1946 Elder et al. ..... 165/145 X
2,973,944 3/1961 Etter ..... 165/145
3,013,773 12/1961 Campbell et al. ..... 165/139 X

FOREIGN PATENT DOCUMENTS 1464836 11/1966 France ..... 122/510

*Primary Examiner*—Allen J. Flanigan
*Attorney, Agent, or Firm*—McGlew & Tuttle

[57] ABSTRACT

A heat exchanger arrranged in a horizontally positioned container for carrying extremely hot gaseous or vapor media, a heat exchanger unit including a bank of tubes defined by tube walls, an inner port, a collector connected to the inlet port and connected to the tubes, first and second outlet ports, first and second outlet port ocllectors each outlet port collector being connected to the outlet ports and a bracket suspension connected to passages of the container for suspendedly supporting each of the inlet port and the outlet ports. The inlet and outlet ports each have a central axis, each central axis passing through a center of gravity of the portion of the heat exchanger unit connected to the associated port. The each of the heat exchanger units includes, the bank of tubes formed of tube walls, inlet ports being connected to the collector and the outlet ports being connected to each of the first and second outlet collectors.

6 Claims, 3 Drawing Sheets

FORCE FREE SUSPENSION OF HEAT EXCHANGE BUNDLES WITH HIGH TEMPERATURE ADMISSION FLOW

FIELD OF THE INVENTION

The present invention pertains to a heat exchanger arranged in a horizontally positioned container intended to carry extremely hot gaseous or vapor media, with a bank of tubes consisting of tube walls, suspended on the collector with inlet and outlet ports.

A fluidized-bed generator (West German Patent Specification No. 24,23,951) for generating gas from coal and steam under increased pressure is known, in which the heat is supplied by heating tubes into a stationary horizontal retort. Meander-shaped or hairpin-like heating tubes, which are bent in planes at right angles to the longitudinal extension of the retort, immerse from the top into the inside space of the retort. Heating tubes arranged one behind another are connected to common collecting tubes located in the upper zone of the retort, which collectors are mounted on support members. These support members are angle irons or other similar suspensions.

According to West German Patent Specification No. 29,10,437, these support members are box-type, internally cooled and externally insulated straight girders. The straight girders have suspension tubes, which are led through the jacket of the retort. Like the straight girders, these suspension tubes are designed for cooling by means of a liquid coolant. The suspensions are supported via cylinders acting as compensating elements, which are under permanent pressure.

According to West German Patent Specification No. 29,10,437, the collector tubes of each retort connection can be connected to an inlet port and outlet port each, which are led through the retort wall, with a spherical collector each.

Thus, according to the state of the art, collectors and/or tube walls of the heat exchanger are provided with cooled or noncooled beams and connecting rods. Such an arrangement may be the cause of different thermal expansions, which may influence each other in an unfavorable manner. The suspension of collector tubes and banks of tubes by means of the above-mentioned suspension tubes requires additional passages through the container wall and consequently entails sealing problems. Another disadvantage is the fact that the support of the suspension with suspension tubes is relatively complicated, and it requires regular maintenance as a consequence of the components used, such as springs and compensators.

SUMMARY AND OBJECTS OF THE INVENTION

It is an object of the present invention to provide a suspension for banks of tubes of heat exchangers in horizontal vessels exposed to high temperatures, in which no or only minor constraining forces occur due to the different thermal expansions of the components. Frictional forces, which may occur between support beams and tubes of a bank according to the state of the art, are to be avoided. The torque-free suspension of the components of the heat exchanger is to be achieved according to the invention without additional passages through the container surrounding the heat exchanger.

It is a further object of the invention to provide a suspension tube arrangement which is maintenance free.

According to the invention, a heat exchanger is provided arranged in a horizontally positioned container which is intended to carry extremely hot gaseous or vapor media. The arrangement includes a bank of tubes including tube walls, suspended on collectors with inlet and outlet ports for the heat exchange medium. Each unit is formed by the bank of tubes formed of tube walls, an inlet port with a collector or manifold and two outlet ports with two collectors each. A heat exchanger is suspended on the inlet port and the two outlet ports which ports are in turn supported on brackets or the like formed in the container passage. The heat exchanger unit is alternatively provided with one inlet port with one collector and one outlet port with two collectors. The axis of the inlet and outlet ports are provided passing through the center of gravity of the heat exchanger parts suspended on the ports.

The suggestion according to the present invention permits suspension of extremely hot banks of tubes of heat exchangers without constraints in horizontal containers, and, moreover, the suspension is designed such that it is maintenance-free.

Each heat exchanger unit, consisting of a bank of tubes formed by tube walls with the collectors, is suspended, according to the present invention, in the area of the passages for the inlet and outlet ports, and it is able to expand freely in all directions. The residual differential expansions between the inlet and the outlet are absorbed by the tube walls.

A further object of the invention is to provide a heat exchanger unit suspension arrangement which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF THE PREFERRED EMBODIMENT

Figure 1:
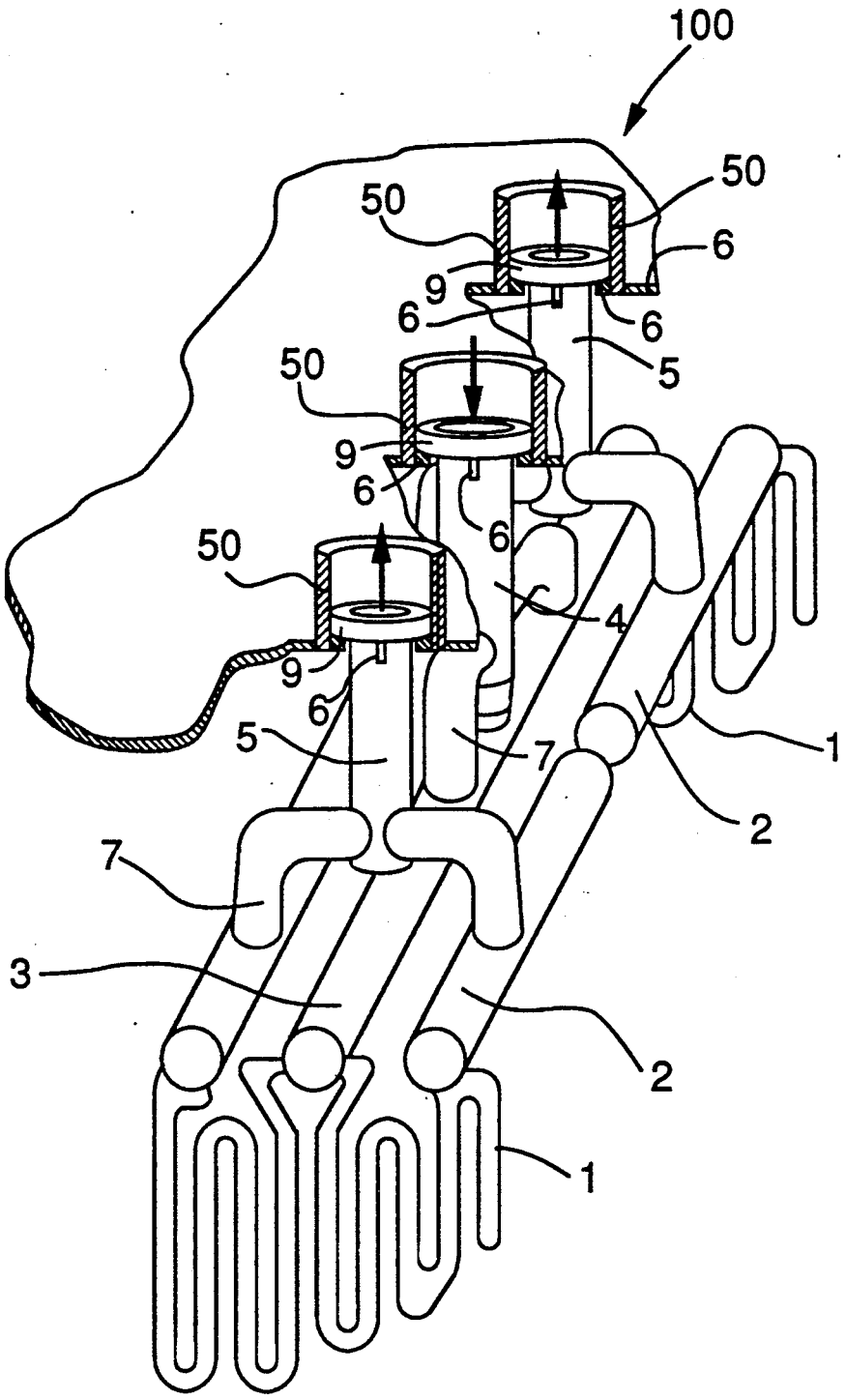
FIG. 1 is a isometric partially sectional view of the suspension of the heat exchanger according to the invention.

Referring to the drawings in particular, the invention comprised a heat exchanger suspension arrangement generally designated 100. The horizontal container 50 with walls surrounding the heat exchanger has been substantially omitted in the drawings. The exemplified embodiments also show only one heat exchanger unit, which is immersed in the container like immersion heater. Thus, second or further units can also be arranged next to each other in the container.

According to FIG. 1, the system of banks of tubes consists of tubes bent in a meandering pattern, which open into superjacent collector tubes 2, 3. The system formed by tube walls 1 has an inlet port 4 for admitting the hot medium, with collector 3, and two outlet ports 5 with two collectors 2 each.

Each heat exchanger unit, consisting of banks of tubes is formed by tube walls 1, the collectors 2, 3, and feed and drain pipes 7 positioned between collectors, and inlet ports 4 and outlet ports 5. The inlet and outlet ports 4, 5 are suspended in the area of the passages for the inlet and outlet ports on the container wall 50 and are supported on brackets 6 or the like.

The axes of the inlet ports 4 and of the two outlet ports 5 are to pass approximately through the center of gravity of the heat exchanger parts located vertically under the respective port suspensions, i.e., the corresponding parts of the tube walls 1, the collectors 2, 3, the feed and drain pipes 7, and the respective ports 4, 5.

Figure 2:
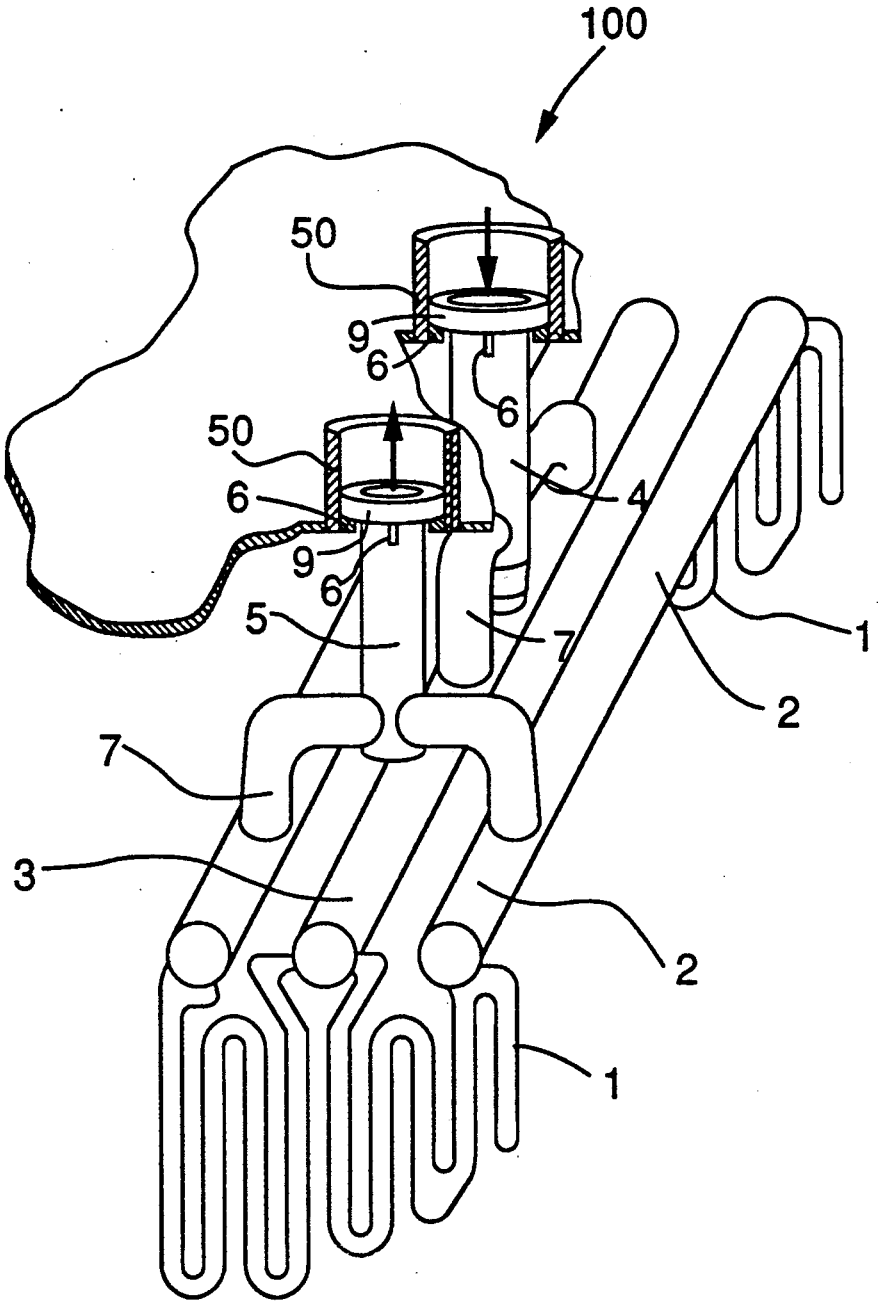
FIG. 2 is a view similar to FIG. 1 of an alternative of the heat exchanger suspension according to the invention.

The tube walls 1 of the bank of tubes according to FIG. 2 also consist of tubes bent in a meandering pattern including a first set of tubes 1*a*, a second set of tubes 1*b* a third set of tubes 1 *c* and a fourth set of tubes 1*d*, which open into superjacent collector tubes 2, 3. This system of the tube walls 1 has an inlet port 4 for admitting the hot medium, with collector 3 and, in contrast to the exemplified embodiment according to FIG. 1, only one outlet port 5, with two collectors 2.

The heat exchanger unit 100, consisting of the bank of tubes formed by the tube walls 1, the collectors 2, 3, including for example outlet port collectors 2*a*, 2*b*, 2*c*, 2*d* (FIG. 1) and the inlet and drain pipes 7 between collectors and inlet port 4, and the outlet port 5, is suspended in the area of the two passages of the inlet port and outlet port on the container wall 50 and is supported on brackets 6 or the like.

Figure 3:
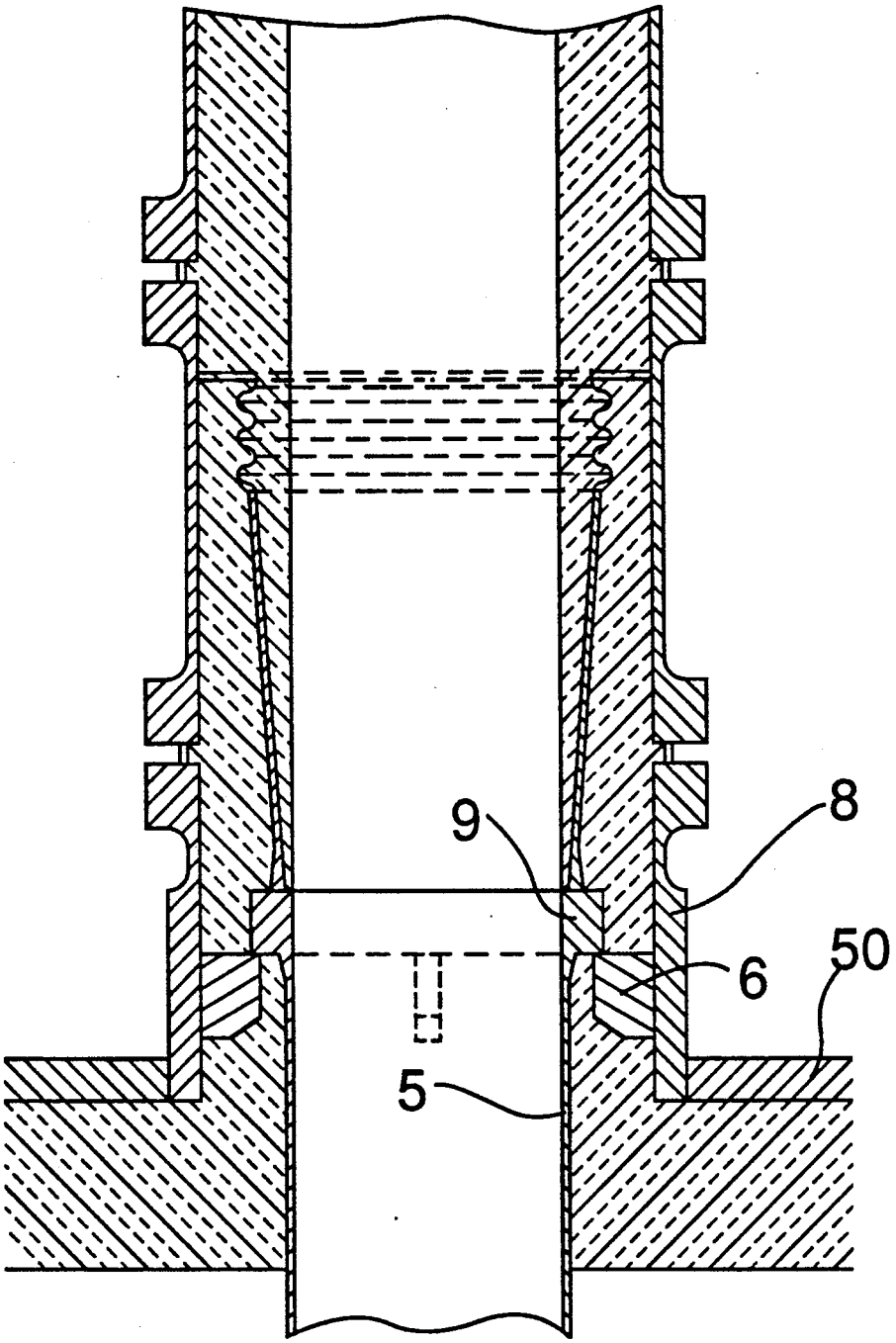
FIG. 3 is a sectional view illustrating a connection between outward ports of the system of banks of tubes and a pressure vessel outward port.

With regard to details of the passage for the ports and sealing, which are not the subject of the present invention, we refer, e.g., to DE 38 23 810.1-24 (Patent Application No. P 38,23,810.1-24 corresponding to U.S. Patent application Ser. No. 378,082 filed July 11, 1990) which is hereby incorporated by reference. FIG. 3 is an enlarged sectional view showing a port such as outward port 5 connected to a corresponding port 8 of the container or vessel 50. The brackets 6 are connected to the interior wall of the container port 8 as shown in each of FIGS. 1, 2 and 3. A flange 9 is provided engaging the brackets 6.

Another known manner of passing through hot pipelines consists of the use of so-called thermal sleeves.

While specific embodiments of the invention have been shown and described in detail to illustrate the application of the principles of the invention, it will be understood that the invention may be embodied otherwise without departing from such principles.

What is claimed is:

1. A heat exchanger arranged in a horizontally positioned container for carrying extremely hot gaseous or vapor media comprising:

a heat exchanger unit including a bank of tubes defined by tube walls, an inlet port, a collector connected to said inlet port and connected to said tubes, an outlet port, first and second outlet port collectors each outlet port collector being connected to said outlet port and connected to said tubes; and bracket suspension means connected to passages of said container for suspendedly supporting each of said inlet port and said outlet port and connected bank of tubes.

2. A heat exchanger according to claim 1, wherein an additional outlet port is provided said inlet port; said additional outlet port and outlet port each have a central axis, each of said central axis passing through a center of gravity of the portion of the heat exchanger unit connected to the associated port.

3. A heat exchanger according to claim 1, wherein an additional outlet port is provided, said additional outlet port is provided connected to each of said first and second port collectors, said additional outlet port being connected to said bracket suspension means for suspendedly supporting said additional outlet port.

4. A heat exchanger according claim 3, wherein said outlet port is connected to said first and second port collectors and said additional outlet port is connected to a third pole outlet port collector and a fourth outlet port collector, said third outlet port collector being connected to a third set of tubes and said fourth outlet port collector being connected to a fourth set of tubes, said first and second set of tubes and said first and second outlet port collectors having a first outlet center of gravity having a central axis of said inlet port located passing through said first outlet center of gravity and said third and fourth set of tubes and said third and fourth outlet port collectors having a second outlet center of gravity said additional outlet port having a central axis passing through said second outlet center of gravity.

5. A heat exchanger arranged in a horizontally positioned container for carrying extremely hot gaseous or vapor media, comprising:

a heat exchanger unit including a bank of tubes defined by tube walls, said bank of tubes including a first set of tubes and a second set of tubes;

an inlet collector connected to each of said first set of tubes and said second set of tubes;

a first outlet collector connected to said first set of tubes;

a second outlet collector connected to said second set of tubes;

an outlet port connected to said outlet collector;

an inlet port connected to said inlet collector; and bracket suspension means connected to passages of said container for suspendedly supporting each of said inlet port and said outlet port and said connected collectors and tubes.

6. A heat exchanger arranged in a horizontally positioned container for carrying extremely hot gaseous or vapor media, comprising:

a heat exchanger unit including a bank of tubes defined by tube walls, said bank of tubes including a first set of tubes, a second set of tubes, a third set of tubes and a fourth set of tubes;

an inlet collector connected to each of said first set of tubes, said second set of tubes, said third set of tubes and said fourth set of tubes;

a first outlet collector connected to said first set of tubes;

a second outlet collector connected to said second set of tubes;

a third outlet collector connected to said third set of tubes;

a fourth outlet collector connected to said fourth set of tubes;

a first outlet port connected to said first and second outlet collectors;

a second outlet port connected to said third and fourth outlet collectors;

an inlet port connected to said inlet collector; and bracket suspension means connected to passages of said container for suspendedly supporting each of said inlet port and said first outlet port and said second outlet port and said connected collectors and tubes.

* * * * *